United States Patent [19]

Santini

[11] Patent Number: 4,696,729

[45] Date of Patent: Sep. 29, 1987

[54] ELECTROPLATING CELL

[75] Inventor: Hugo A. A. Santini, San Jose, Calif.

[73] Assignee: International Business Machines, Armonk, N.Y.

[21] Appl. No.: 834,699

[22] Filed: Feb. 28, 1986

[51] Int. Cl.[4] ..... C25D 17/06; C25D 17/16

[52] U.S. Cl. ..... 204/224 R; 204/237; 204/273; 204/275; 204/297 R

[58] Field of Search ..... 204/273, 275, 237, 297 R

[56] References Cited

U.S. PATENT DOCUMENTS

| | | | |
|---|---|---|---|
| 3,458,421 | 7/1969 | Dahms | 204/275 X |
| 3,652,442 | 3/1972 | Powers et al. | 204/273 |
| 3,933,615 | 1/1976 | Levenson | 204/275 |
| 4,053,377 | 10/1977 | Schlain et al. | 204/275 X |
| 4,085,010 | 4/1978 | Ishimori et al. | 204/16 |
| 4,102,756 | 7/1978 | Castellani et al. | 204/43 T |
| 4,376,031 | 3/1983 | Andrus et al. | 204/275 X |
| 4,560,460 | 12/1985 | Bläsing et al. | 204/275 X |

*Primary Examiner*—Donald R. Valentine

*Attorney, Agent, or Firm*—Otto Schmid, Jr.

[57] ABSTRACT

An electroplating cell having a cathode assembly which is vertically mounted and which holds a plurality of wafers to be plated, and an anode which is vertically mounted adjacent to the cathode assembly. The anode and cathode are spaced apart and form opposite walls of a channel through which the plating bath flows. The plating bath is introduced through an isostatic chamber which produces, at its output, a substantially equal flow across the width of the channel so that a substantially vertical laminar flow is produced through the channel and the plated deposits are of uniform thickness within a wafer, from wafer to wafer and from batch to batch.

12 Claims, 4 Drawing Figures

ELECTROPLATING CELL

FIELD OF THE INVENTION

This invention relates to an electroplating cell and more particularly to an improved cell for electrodepositing metallic films having uniform thickness.

DESCRIPTION OF THE PRIOR ART

Electroplating has been used for many years in the manufacturing of magnetic devices and thin film electronic components. One of the severe problems in the use of electroplating in these applications is maintaining the required thickness uniformity and the uniformity of other characteristics such as grain size and maintaining the plated film free from defects. These problems have become more severe as the physical size of the manufactured parts has gotten progressively smaller.

U.S. Pat. No. 3,652,442 to Powers et al shows a plating cell which includes a reciprocating arm with a stirring paddle which moves back and forth along the length of the cathode and just above the surface of the cathode. As a result, a homogenization of the bath solution occurs upon the surface of the cathode and the agitating means is adapted to cause a laminar flow of the bath across the surface of the cathode. However, the reciprocating motion of the stirring paddles does not produce a laminar flow over the entire flow path for all parts of the plating cycle, and this patent does not provide any means for circulating or replenishing the bath.

U.S. Pat. No. 4,102,756 to Castellani et al describes a plating cell which includes a paddle agitator which is moved back and forth at a uniform rate near the center of the cell where the electrodes are located. This plating cell provides means for recirculating the plating bath which is directed downward through an opening toward the horizontally mounted cathode in a continuous laminar regime of mixing and the plating solution is taken away from the cell for recirculation. Although this patent discloses means for recirculating the plating bath, it uses a similar reciprocating stirring paddle motion as the Powers et al patent, so it does not produce a laminar flow over the entire flow path for all parts of the plating cycle.

U.S. Pat. No. 4,085,010 to Ishimori et al describes an electroplating apparatus in which a powdery material is uniformly dispersed in the plating solution. The plating solution is introduced at the bottom of the cell by a pump from one of three different storage tanks and the solution flows upwardly past the electrodes and overflows into a recycling tank surrounding the cylindrical plating tank. In one embodiment a dispersion plate is installed at the bottom of the cylindrical plating tank to disperse the powdery material uniformly and to separate individual fine particles. However this apparatus produces a non-uniform flow across the flow channel between the anode and the cathode, thereby making the thickness of the plated deposits dependent upon the position within the flow path.

SUMMARY OF THE INVENTION

It is therefore an object of this invention to provide an improved electroplating cell.

It is another object of this invention to provide an improved electroplating cell in which metal films having uniformity of thickness and other properties can be deposited.

These and other objects are accomplished according to the present invention by an electroplating cell comprising first and second spaced wall members fixed in position to define a channel between the wall members which serves as a flow path for the plating solution. The anode forms at least a part of one of the wall members, and the cathode, which includes an article to be plated, forms at least a part of the other wall member. The plating solution is introduced into the plating cell under pressure, and is directed to an isostatic chamber which equalized the pressure over the entire area of the channel so that a laminar flow of the plating solution is produced along the length of the channel flow path. A uniform current density is produced across the electrodes, in the presence of the laminar flow so that a metal film of uniform thickness is plated on the article.

The foregoing and other objects, features and advantages of the invention will be apparent from the following more particular description of a preferred embodiment of the invention as illustrated in the accompanying drawings.

DESCRIPTION OF THE PREFERRED EMBODIMENTS

Figure 1:
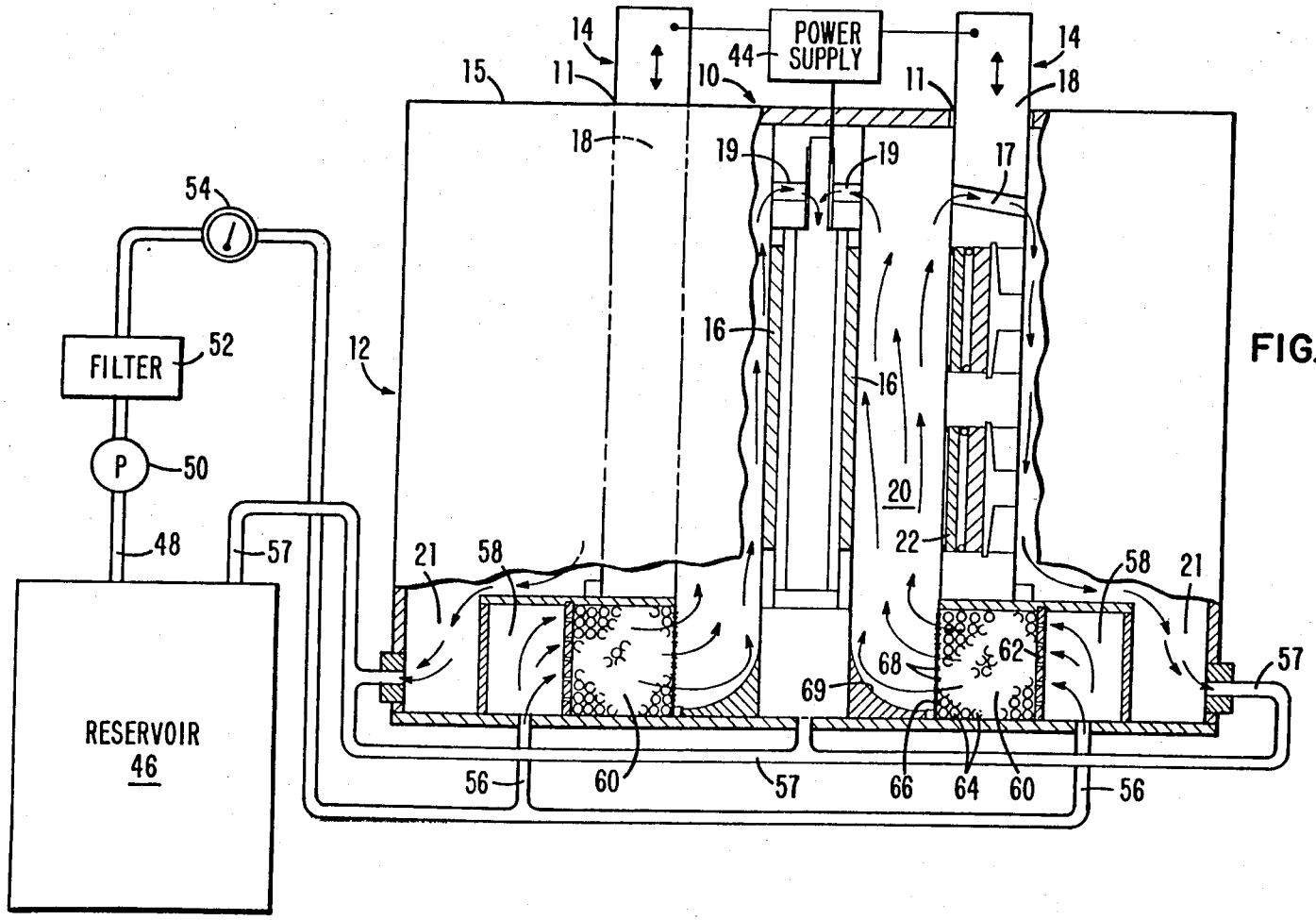
FIG. 1 is a side view, partially in section, of a specific embodiment of the electroplating cell embodying the invention.
Figure 2:
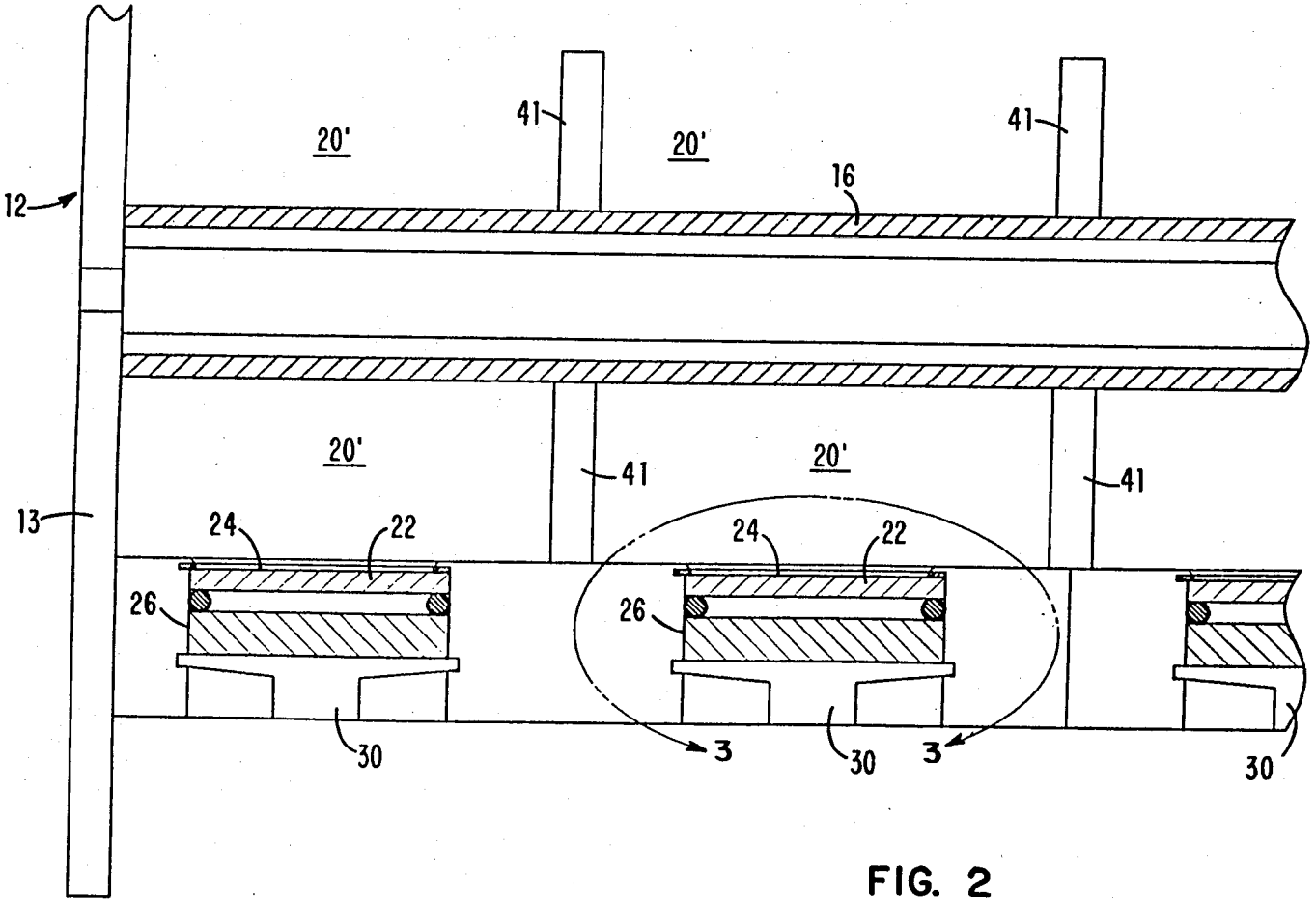
FIG. 2 is a top view, partially in section, of the specific embodiment of the electroplating cell shown in FIG. 1.

The plating cell, according to the invention, comprises an enclosed tank, a cathode assembly which is vertically mounted and which holds a plurality of wafers upon which a thin metal film is to be plated, and an anode which is vertically mounted adjacent to the cathode assembly. The anode and the cathode are spaced apart and form opposite walls of a channel through which the plating bath is provided in a substantially laminar flow. The plating cell structure of the present invention permits plating which has uniform thickness within each wafer, from wafer to wafer and from batch to batch.

In the embodiment of the invention shown in the drawings, the plating cell 10 comprises a rectangular tank 12 which is made from a material which is non-conductive and does not interact with the acid plating bath, such as poly (methyl-methacrylate) (PMMA) or polypropylene, for example. In the embodiment shown two anodes and two cathode assemblies are shown, but only one of the anodes and cathode assemblies will be described in detail since the design of all anodes and cathode assemblies is similar to that described. An anode 16 is provided which forms a major part of a wall member which extends from one wall of the tank 12 to the opposite wall. The anode 16 is formed of the same metal as the metal to be plated. For example, if copper is to be plated on the wafers, then the anode is made of pure copper or copper with a minor additive, such as 5% phosphorus to improve grain size control, for example.

The embodiment of the cathode assembly 14 shown in the drawings comprises a holder 18 which extends from one wall of tank 12 to the opposite wall of the tank in a vertically extending plane that is substantially parallel to the anode 16 to form a channel 20 through which the plating bath is directed vertically upward in a laminar flow. Holder 18 mounts a plurality of wafers 22 upon which a metallic coating is to be electroplated. The wafers are formed of a suitable substrate material such as a ceramic material, for example, and one surface 24 of the wafers 22 is coated with a thin film conductive coating of the same material as the material to be plated by vacuum deposition, E beam deposition or sputtering, for example.

Figure 3:
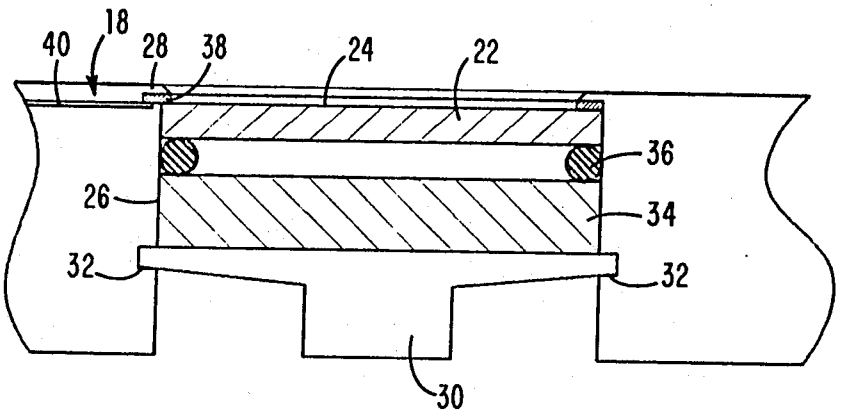
FIG. 3 is a partial section view taken along the lines 3—3 of FIG. 2.
Figure 4:
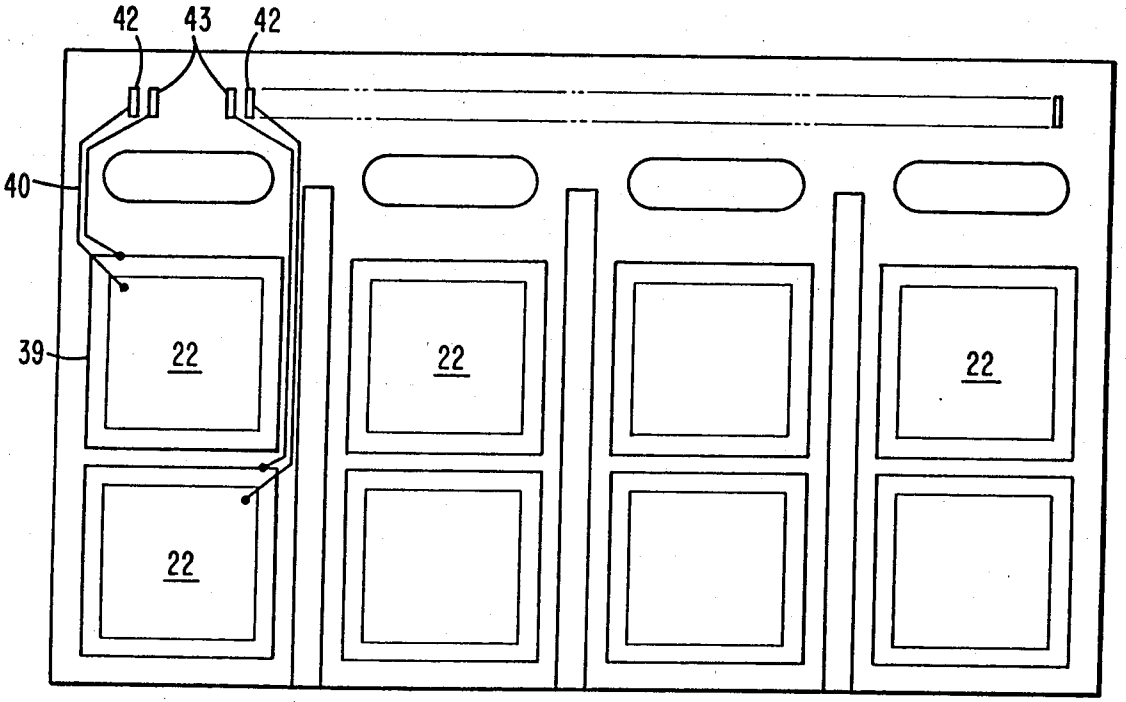
FIG. 4 is a plan view of a specific embodiment of the cathode assembly of the electroplating cell.

Holder 18 is made from a non-conductive material which does not react with the acidic plating bath such as PMMA or polypropylene, and has a plurality of openings 26 into which the wafers 22 are mounted in a fixed position. Each of the openings 26 has a reduced area lip 28 (FIG. 3) against which one of the wafers is mounted in a position so that a seal is formed to prevent the plating bath from contacting the sides or rear surface of the wafer. Each of the wafers is held in position by a clamp mechanism 30 which, when turned one-quarter turn, produces a camming engagement with slots 32 in the walls of opening 26 to produce a force sufficient to move pressure plate 34 into engagement with O-ring seal 36 which presses surface 24 of wafer 22 into engagement with conductive gasket 38. Conductive gasket is designed to provide a uniform peripheral contact to the thin conductive coating on surface 24 of wafers 22. Conductive gasket 38 may comprise a thin conductive metal such as stainless steel, brass or berryllium copper. In this case, the gasket 38 is shaped by punching or machining, is flat annealed after shaping and then gold plated to minimize dissolution of the gasket material in the plating bath. Alternatively, conductive gasket 38 may be made from a conductive elastomer such as a silver loaded silicone rubber material, for example. A conductor 40 is included within holder 18 which extends from a position in contact with conductive gasket 38 to a terminal 42 to which a suitable power supply connection can be made. The power supply 44 is connected between the anode 16 and the terminals 42, one of which is provided for each wafer 22 of cathode assembly 14.

In the embodiment of the invention shown in the drawings, a short wall member 41 is provided which extends from the anode 16 toward the cathode 14 so that, when the cathode assembly 14 is in place, a channel 20' is provided for each two wafers 22. This structure has the advantage that each pair of wafers 22 can be controlled to different characteristics, if desired. This construction has the additional advantage that the number of wafers to be plated can be varied in increments of two wafers from two up to the maximum capacity of the cell and still retain the characteristics of uniform thickness plating. In this case a blank piece of an inert material such as glass which has the same size as that of the wafers is inserted into openings 26 to close these openings and thereby maintain the laminar flow of plating bath. If desired, a thieving ring 39 may be provided surrounding each wafer 22, and in that case a further terminal 43 is provided for each wafer 22 of the cathode assembly 14. A thieving ring 39 is a conductive element which surrounds the wafer 22, and is operable to produce a greater uniformity control. A variable resistor is connected in the circuit from power supply to the thieving ring 39 and a second variable resistor is connected in the circuit from the power supply 44 to the wafer 22. The variable resistors are adjusted prior to the plating operation to maintain a constant preselected current bias ratio between the wafer 22 and thieving ring 39 during the plating process.

The plating bath is supplied to inlet 58 of cell 10 from a suitable reservoir 46 by means of tube 48, pump 50, filter 52, pressure regulator 54 and tube 56. The inlet 58 comprises a common manifold which supplies plating bath under pressure to an isostatic chamber 60 which produces, at its output side, a laminar flow of plating bath which has uniform flow across each channel 20'. The isostatic chamber 60 is separated from inlet 58 by means of a perforated plate 62 having openings from 2 to 4 mm, for example, which serves to distribute the flow across the chamber. The isostatic chamber is filled with a plurality of generally spherical beads 64, the size of which is chosen to produce the desired flow through channel 20. In a particular application, glass beads in the range of 4 to 6 mm worked well. Beads 64 are made from an inert material such as glass or teflon, and these beads 64 are held in position by means of a thin membrane member 66. Membrane 66 has a plurality of spaced orifices 68 to form a fine mesh screen so that a laminar flow of the plating bath is produced having substantially equal flow at the output end of the isostatic chamber 60. In a particular application, a teflon screen with orifices within the range of 10 to 25 microns was used. A shaped deflector 68 is provided to direct the plating bath in a substantially vertical laminar flow which has a substantially equal flow across the width of channel 20. The continuous vertical flow has the advantage that any hydrogen gas and/or any particulate material formed during the plating operation is/are swept away from the face of the article to be plated. This sweeping action prevents voids from forming in the plated film due to hydrogen gas bubble accumulation or due to other causes.

The plating cell 10 is operated by inserting cathode 14 through openings 11 in the cover 15 of tank 12 to produce a sealed enclosure with the side walls 13 of tank 12. Flow of the plating bath is started, and the level of plating bath in channels 20 rises until the level reaches openings 17 in holder 18 and openings 19 in anode 16. Openings 17 and 19 are past the wafers 22 in the vertical direction so that a laminar flow will be present for all areas to be plated. The plating bath overflows through openings 17 and 19 to a sump 21 from which the plating bath is returned through tube 57 to the reservoir 46 for treatment for temperature and pH control, for example. The continuous flow of the plating bath through the plating cell is continued for a predetermined time which is chosen so that the acid plating bath removes any oxidation from the cathode and the anode and to provide the time required for the system to reach thermal equilibrium. After the predetermined time, the current from power supply 44 is turned ON to both the wafers 22 and thieving rings 39 for a predetermined time based on the thickness to the plated. Once the desired thickness is plated, the cathode assembly is removed vertically from the plating cell. Since one wall of channel 20 is opened by this action, the flow of the plating solution is from the isostatic chamber to the sump. The level of the plating solution is below the bottom of the anode member, and, as a result, the plating bath composition is not altered by the continuous dissolution of the anode material by the acidic plating bath during non-plating intervals.

EXAMPLE I

A plurality of wafers of a ceramic material comprising a mixture of aluminum oxide and titanium carbide with a flash coating of copper sputtered on one face of the wafers was plated with copper with the apparatus of the present invention to provide a plurality of copper patterns thereon. For this plating, the plating bath comprised copper sulphate, sulfuric acid and deionized water to a pH of 2.5. The bath was maintained to a temperature of 20° C. and the continuous flow rate was about 0.6 gallons per minute. With this plating bath, copper was deposited at the rate of 1000 angstroms per minute. The plated copper had a thickness uniformity within a wafer, from wafer to wafer and from batch to batch of better than ±2%. The plated deposits had an average grain size of about 1.5 to 3 microns, and the high density plating deposits were void free and lamination free.

While the invention has been particularly shown and described with reference to a preferred embodiment thereof, it will be understood by those skilled in the art that various other changes in the form and details may be made therein without departing from the spirit and scope of the invention.

Having thus described my invention, what I claim as new, and desire to secure by Letters Patent is:

1. An electroplating cell comprising:

first and second spaced wall members fixed in position to define a channel which provides a flow path for plating solution between said wall members;

a first elongated electrode forming at least part of said first wall member;

a second elongated electrode forming at least part of said second wall member, said second electrode including an article to be plated;

input means for introducing a plating solution under pressure to said plating cell;

an isostatic chamber for receiving plating solution from said input means and for discharging said plating solution into said flow path at a substantially equal predetermined pressure over the entire area of said flow path so that a uniform laminar flow of said plating solution is produced along the length of said flow path; and means for producing a uniform current density across said electrodes in the presence of said laminar flow of said plating solution whereby a film of uniform thickness is plated on said article.

2. The electroplating cell according to claim 1 wherein said isostatic chamber comprises a plurality of bead members held in a fixed position between perforated members.

3. The electroplating cell according to claim 2 wherein said perforated member at the discharging end of said isostatic chamber comprises a membrane having orifices within the range of ten to twenty-five microns.

4. The electroplating cell according to claim 1 wherein said second electrode comprises a cathode assembly which includes a plurality of articles to be plated, each of said articles having a planar face upon which a plated deposit can be made.

5. The electroplating cell according to claim 4 wherein said articles to be plated comprise wafers and said cathode assembly comprises a non-conductive holder member, means for mounting each of said wafers within an opening in said holder member; and a conductive gasket member fixed in contact with the peripheral area of said planar face of each of said wafers.

6. The electroplating cell according to claim 5 wherein said conductive gasket member comprises a thin metal member.

7. The electroplating cell according to claim 1 additionally comprising;

an elongated opening in each of said wall members along said flow path after the location of said article to be plated to receive said plating bath for recirculation.

8. The electroplating cell according to claim 4 wherein said cathode assembly is removably mounted so that removal of said cathode assembly opens said second wall member whereby the plating solution is not altered by continuous dissolution of said anode said plating solution during non-plating intervals.

9. The electroplating cell according to claim 1 wherein said laminar flow of said plating solution is a substantially vertical flow.

10. The electroplating cell according to claim 9 additionally comprising:

an elongated opening in each of said wall members along said flow path after the location of said article to be plated to receive said plating bath for recirculation.

11. The electroplating cell according to claim 9 wherein said laminar flow of said plating solution along said flow path is generally upward.

12. The electroplating cell according to claim 1 wherein said laminar flow of said plating solution along said flow path is generally upward.

* * * * *